US007290590B2

(12) United States Patent
Wagner

(10) Patent No.: US 7,290,590 B2
(45) Date of Patent: Nov. 6, 2007

(54) APPARATUS AND PROCESS FOR PRODUCING SHAPED PARTS

(75) Inventor: Walter Wagner, Niederburen (CH)

(73) Assignee: Aluwag AG, Niederburen (CH)

( * ) Notice: Subject to any disclaimer, the term of this patent is extended or adjusted under 35 U.S.C. 154(b) by 0 days.

(21) Appl. No.: 11/237,787

(22) Filed: Sep. 29, 2005

(65) Prior Publication Data

US 2006/0065384 A1 Mar. 30, 2006

(30) Foreign Application Priority Data

Sep. 30, 2004 (EP) ..... 04023277

(51) Int. Cl.
*B22D 17/00* (2006.01)

(52) U.S. Cl. ..... 164/312; 164/113

(58) Field of Classification Search ..... 164/113, 164/312

See application file for complete search history.

(56) References Cited

U.S. PATENT DOCUMENTS 3,959,872 A * 6/1976 Abe ..... 29/527.4
5,560,419 A 10/1996 Yoshida et al.
5,755,848 A * 5/1998 Tsuchimoto et al. ..... 65/305
6,715,207 B2 * 4/2004 Michioka et al. ..... 29/898.047

FOREIGN PATENT DOCUMENTS

| | | | |
|---|---|---|---|
| DE | 4441735 | 5/1996 | |
| JP | 60250866 | * 12/1985 | ..... 164/312 |
| JP | 07155925 | * 6/1995 | ..... 164/312 |
| WO | WO96/38246 | 12/1996 | |
| WO | WO2004/009273 | 1/2004 | |

* cited by examiner

*Primary Examiner*—Kevin Kerns
*Assistant Examiner*—Ing-Hour Lin
(74) *Attorney, Agent, or Firm*—Shoemaker and Mattare

(57) ABSTRACT

An apparatus for producing a shaped part has a shot sleeve. A melt can be fed into the shot sleeve. The melt can be forced into a die by means of an injection plunger. The apparatus is provided with a drive unit for actuating the plunger rod. Moreover, the apparatus has an oscillation generator, by means of which the plunger rod can be set in longitudinal oscillations. The plunger rod is moveably connected to the drive unit.

18 Claims, 3 Drawing Sheets

APPARATUS AND PROCESS FOR PRODUCING SHAPED PARTS

CROSS-REFERENCE TO RELATED APPLICATION

This application claims for foreign priority under 35 U.S.C. 119(a)-(d) to European Application No. 04023277.9, filed Sep. 30, 2004.

BACKGROUND OF THE INVENTION

The invention relates to an apparatus and a process for producing shaped parts having the features of the generic part of the independent patent claims. The apparatus and process are suitable in particular for pressure die casting in a cold-chamber process, in particular for the pressure die casting of aluminum. Pressure die casting is an economical production process which is in widespread use for the production of shaped parts. In this process, a melt of the material which is to be shaped is introduced into a shot sleeve and moved in the direction of a die by means of an injection plunger in the shot sleeve. The movement of the melt in the shot sleeve is initially relatively slow. Ultimately, the melt is forced into the die under pressure in what is known as a shot.

One problem with processes of this type is that the melt contains gases which if possible should be removed from within the melt during the movement of the melt. Since the surface of the melt is in contact with cold walls in the shot sleeve, a skin is formed on the surface of the melt. Consequently, gases contained in the melt find it difficult to escape. This can give rise to quality problems.

It has long been known to use vibrations to improve the workpiece quality in casting processes. For example, it is known from JP 60 250 866 to provide a plunger rod with a pressure head having a resonator. The resonator generates a high-frequency oscillation which is transmitted to the melt via the head. The intention is for the melt to penetrate even into thin gaps in the die.

WO 2004/09273 discloses an apparatus for forming a crystallizable material in the liquid or pasty state. According to this disclosure, the material is made to oscillate, at least in some regions, before and/or during forming and/or solidification. The document proposes, inter alia, connecting an oscillation generation unit to the hydraulic pressure line which is used to move the injection plunger.

However, these known apparatuses all have certain drawbacks. In particular, it is difficult to use the hydraulic pressure line to transmit oscillations to the injection plunger sufficiently quickly and in a sufficiently controlled fashion. Moreover, it is complex and expensive to adapt the hydraulic system.

Considerable acceleration forces act on the injection plunger during the shot of the melt into the die. Consequently, there is a risk of oscillation units which act on the injection plunger as shown in JP 60 250 866 A being destroyed.

SUMMARY OF THE INVENTION

Therefore, it is an object of the present invention to avoid the drawbacks of the prior art, i.e. in particular to provide an apparatus and process for producing a shaped part which allows the quality of the shaped parts to improve in a simple way, in particular prevents or reduces the formation of skin on the surface of the melt. It is to be possible for the apparatus according to the invention to be produced and operated in a simple way. In particular, the apparatus should have long service lives and high reliability despite the use of vibrating parts.

According to the invention, these objects are achieved by an apparatus and a process as described below.

The apparatus for producing a shaped part is of substantially standard design. It has a shot sleeve to which a melt can be fed. An injection plunger for moving the melt into a die is mounted displaceably in the shot sleeve. The apparatus has a drive unit for actuating the injection plunger. This is typically a hydraulic drive. The apparatus is provided with at least one oscillation generator, by means of which the injection plunger can be set in longitudinal oscillation. In this context, longitudinal oscillations are to be understood as meaning oscillations in the longitudinal direction of the injection plunger, i.e. oscillations in its direction of movement. According to the invention, the injection plunger or a plunger rod which bears the injection plunger is moveably connected to the drive unit. A moveable connection between injection plunger or plunger rod and drive unit results in decoupling between injection plunger and drive unit. Consequently, the injection plunger and the plunger rod can move within certain limits with respect to the drive unit. This decoupling allows the injection plunger to be set in oscillation without these oscillations being transmitted to the drive unit.

According to a preferred exemplary embodiment of the injection, the plunger rod is connected to the drive unit in such a manner that it can move in the longitudinal direction. In particular, a sprung connection may be provided between the plunger rod and the drive unit. On account of a sprung connection which can move in the longitudinal direction, the plunger rod can be set in oscillations in the longitudinal direction independently of the drive unit. If acceleration forces occur during the shot, these forces are not transmitted directly from the plunger rod to the drive unit, but rather are absorbed by springs.

It is particularly preferable for the plunger rod to be connected to the drive unit in jointed fashion. In particular if the oscillation direction of the injection plunger is not absolutely identical to the direction of movement of the drive unit, it is in this way possible to prevent the plunger rod from becoming jammed with respect to the drive unit. This allows the wear to be reduced.

Therefore, it is preferable for the plunger rod to be connected to the drive unit in floating fashion and under spring force, in the style of a ball joint. This allows the injection plunger to oscillate independently of the movement of the drive unit without any risk of jamming or of the transmission of pressure shocks.

It is preferable for the plunger rod to have a securing head at its end remote from the melt. The securing head is at least partially rounded and is mounted in sprung fashion in a bearing socket of a connection piece of the drive unit. The securing head can typically be held in the longitudinal direction by a set of springs in the connection piece. However, other sprung bearings which can move in the longitudinal direction would also be possible. For example, it is conceivable to provide other mechanically controlled or pneumatic or hydraulic apparatuses. The force applied should be such that during the application of a force to be melt the injection plunger and the plunger rod remain moveable in the longitudinal direction, i.e. that, for example, springs are not completely compressed. A relatively high pressure prevails in the shot phase. The securing head of the plunger rod can readily bear against the inner surface of the bearing socket.

Moreover, it is preferable for the securing head to be provided with means for reducing the sliding friction between the securing head and the inner surface of the bearing socket. This may typically be a sliding ring made from a material with high sliding properties, such as typically Teflon. However, it is also conceivable for the securing head to be provided with a coating, for example a Teflon coating. The risk of jamming between the drive unit and injection plunger is in this way reduced further in the event of the movement of these components not being parallel.

Moreover, it is preferable for the surface of the bearing socket to be formed from a material which has a greater hardness than the securing head. The surface of the bearing socket may typically be hard chrome plated or ionitrided. The securing head of the plunger rod typically consists of steel.

According to a further aspect of the invention, the oscillation generator is fitted directly to the plunger rod itself. This allows oscillations to be transmitted directly to the melt. There is therefore no need to influence the hydraulics of the drive unit in a complex way. Arranging the oscillation generator directly on the plunger rod in this way is, of course, particularly preferred in particular in conjunction with the decoupled connection between injection plunger or plunger rod and drive unit described above.

In the operating position, the plunger rod of the apparatus according to the invention may in particular run approximately horizontally. In this case, in the operating position the oscillation generator or its housing is preferably arranged directly on the plunger rod in such a manner that it is directed vertically downwards. The oscillation generator has a certain weight. The arrangement directed vertically downwards prevents torques acting on the plunger rod as a result of the force of gravity on the oscillation generator.

The oscillation generator is typically designed to generate oscillations in the low-frequency range, typically between 5 Hz and 100 Hz, preferably between 30 Hz and 50 Hz.

According to a further preferred embodiment of the invention, the bearing socket in which the securing head of the plunger rod is mounted is provided with at least one vent opening. The vent opening prevents air cushions from forming between the surface of the securing head and the inner surface of the bearing socket, which could impede the free movement of the plunger rod with respect to the drive unit.

The process according to the invention for producing a shaped part substantially comprises the steps of introducing a melt into a shot sleeve and forcing the melt into a die. An injection plunger is used for this purpose. In a first movement phase, the melt is moved out of the shot sleeve in the direction of the die. In a second phase, the shot phase, the melt is forced into the die under pressure. According to the invention, the injection plunger is subjected to oscillations in the longitudinal direction during the movement phase.

In this case, the injection plunger is set in oscillation independently of the drive unit, so that no oscillations are transmitted to the drive unit. In particular, the process described can preferably be carried out using one of the apparatuses described above.

BRIEF DESCRIPTION OF THE DRAWINGS

The invention is explained in more detail below in exemplary embodiments and with reference to the drawings, in which.

DESCRIPTION OF THE PREFERRED EMBODIMENTS

Figure 1:
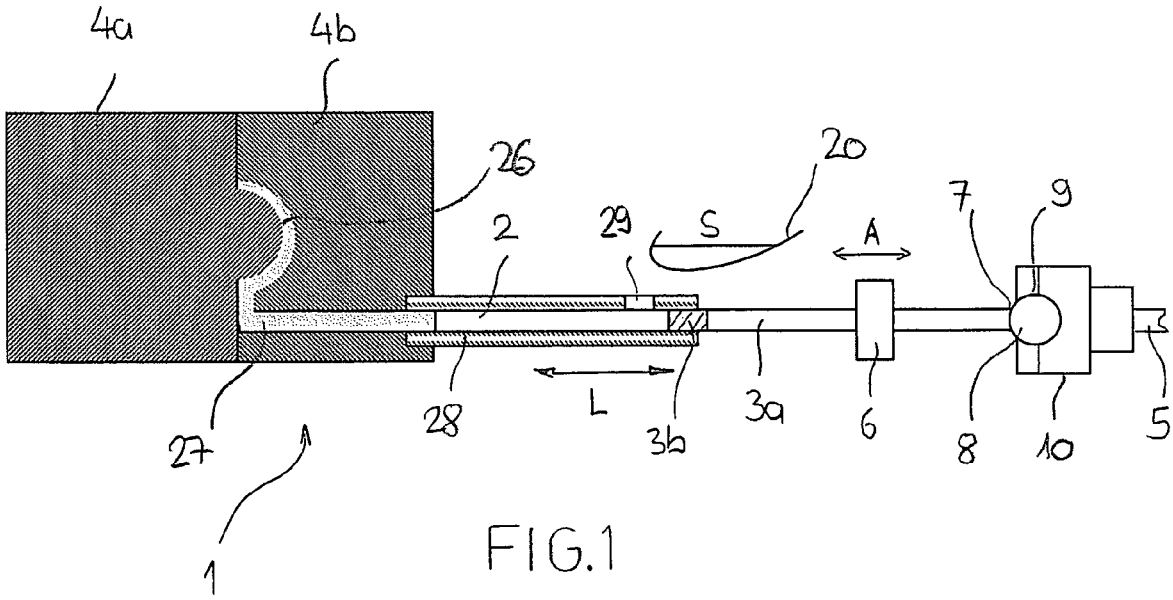
FIG. 1 diagrammatically depicts an apparatus according to the invention.

FIG. 1 shows an apparatus 1 according to the invention for producing a shaped part having the features of the invention. The apparatus 1 has two die parts 4*a*, 4*b*, which together delimit a cavity 26. Metal melt can be forced into the cavity 26 through a gate 27. It is in this way possible to produce shaped parts. The die parts 4*a*, 4*b* can move in a known way so that the cavity 26 can be opened. The mechanism for moving the die parts is not shown in FIG. 1. A shot sleeve 2, which is defined by a cylindrical tube 28, opens out into the gate 27. The tube 28 has an opening 29. Metal melt S can be introduced into the shot sleeve 2 from a crucible 20 through the opening 29. A plunger rod 3*a* mounted displaceably in the cylindrical tube 28 can be displaced in direction L. The plunger rod 3*a* bears an injection plunger 3*b*. By moving the plunger rod 3*a*, it is possible for melt S contained in the shot sleeve 2 to be moved in the direction of the gate 27 and through the latter into the cavity 26. To move the plunger rod 3*a*, the latter is connected to a diagrammatically depicted connection 5 of a drive unit. This drive unit is typically a hydraulic cylinder.

Figure 2:
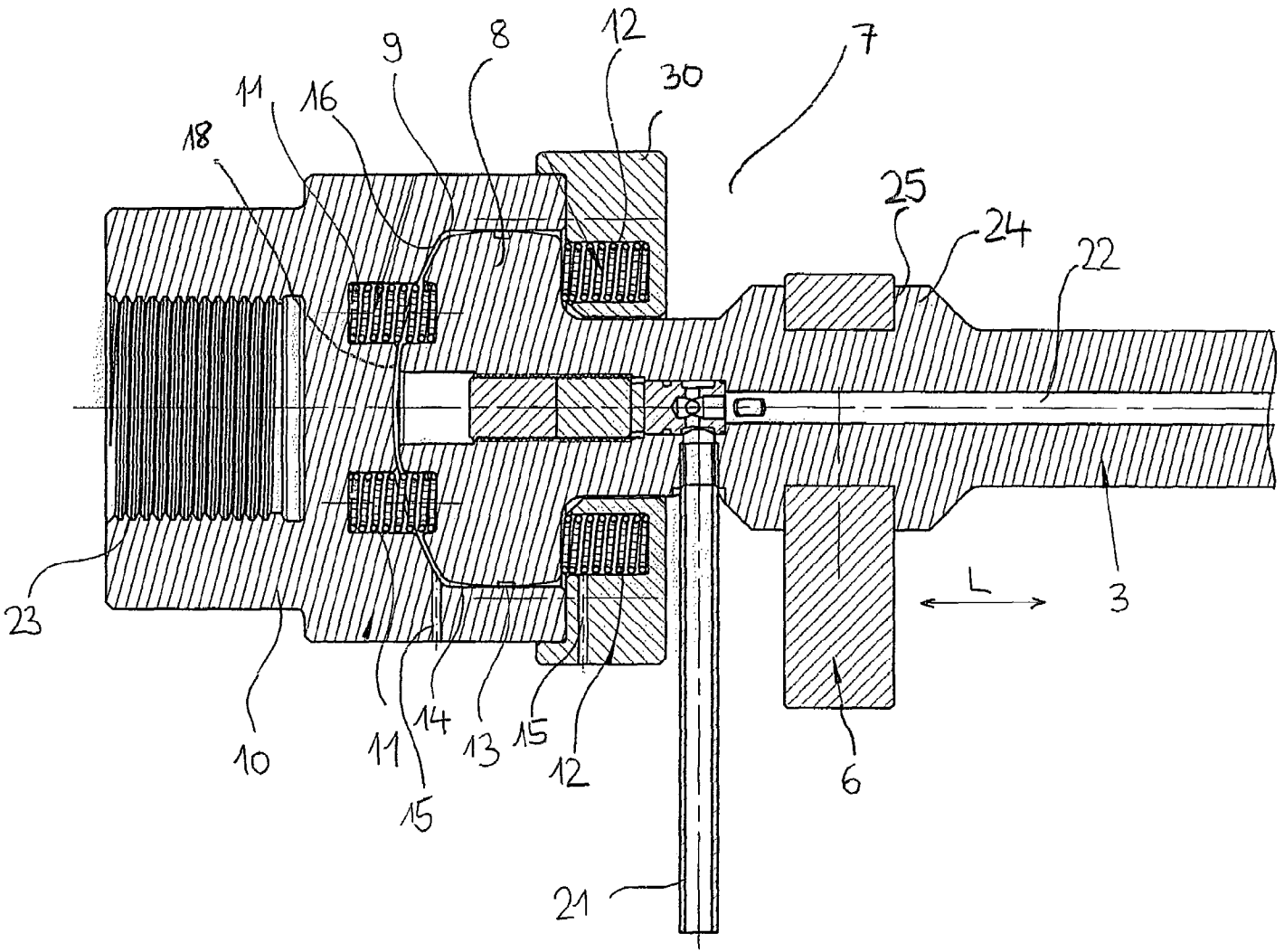
FIG. 2 shows a cross section through the securing head of a plunger rod according to the invention on plane A-A in FIG. 3.

According to the invention, an oscillation generator 6 is arranged on the plunger rod 3*a*. The oscillation generator oscillates in direction A with a frequency of typically 50 Hz. That end 7 of the plunger rod 3*a* which is remote from the dies 4*a*, 4*b* is provided with a securing head 8. The securing head 8 is secured in a bearing socket 9 of a connection piece 10 in the style of a ball joint. The connection piece 10 is or can be connected to the drive unit 5. FIG. 2 provides a more detailed illustration of the securing.

The connection piece 10 is provided with an opening which forms a bearing socket 9 for receiving the securing head 8 of the plunger rod 3*a*.

The securing head 8 of the plunger rod 3 has a rounded surface 14. On account of the rounded shape of the securing head 8, the securing head is mounted pivotably in the connection piece 10. Moreover, in the region in which the rounded surface 14 is in contact with the inner surface 16 of the bearing socket 9, the securing head 8 is provided with a sliding ring 13 of Teflon. A closure piece 30 is secured to the connection piece 10 by screws 17 (cf. FIG. 3). The securing head 8 is held non-positively in the bearing socket 9 in the longitudinal direction L by a set of springs formed by springs 11, 12. The springs 12 are held in the longitudinal direction in the bearing socket 9 by a closure piece 30. The dimensions of the securing head 8 and the bearing socket 9 are such that a narrow gap 18 is formed between the inner surface 16 and the surface 14. Taking account of the force generated by the drive unit 5 and the spring force as well as the oscillation amplitude of the plunger rod 30, the gap width is selected to be such that the securing head 8 does not impact on the inner surface of the bearing socket 9. The dimensions of the springs 11, 12 are such that when the connection piece 10 is actuated with the drive unit 5 in the longitudinal direction L, they move the plunger rod 3*a* and the injection plunger 3*b* which acts on the melt without any contact between the surface 14 of the securing head 8 and the inner surface 16 of the connection piece 10.

The plunger rod 3*a* and in particular the securing head 8 are made from special steel. The connection piece 10 is made from special steel. The inner surface 16 has been treated in such a manner that its hardness is higher than that of the surface 14 of the securing head 8. According to one exemplary embodiment, the surface is hard chrome plated. It could also be ionitrided. By way of example, the springs used are linear springs.

The connection piece 10 is provided with a screw thread 23. The connection piece 10 can easily be connected to the drive unit 5 shown in FIG. 1 by way of the screw thread 23. In particular, it is easy to use different plunger rods 3*a* with corresponding connection pieces depending on the particular application.

According to the invention, the plunger rod 3*a* is provided with an oscillation generator 6. The oscillation generator 6 used is typically a conventional vibrator. One portion of the piston rod 3*a* is provided with a bead 24. The bead 24 has a groove 25. The oscillation generator 6 is arranged in the groove 25 in a positively locking manner in the longitudinal direction L. The plunger rod 3*a* can be vibrated in the longitudinal direction L using the oscillation generator 6. On account of the floating bearing using the springs 11, 12, the vibration can take place in direction L without the drive unit 5 being impaired by the oscillations. In particular, on account of the securing head 8 being mounted in the connection piece 10 in the style of a ball joint, it is impossible for there to be any jamming between the securing head 8 and the connection piece 10 even in the event of the oscillation direction L of the plunger rod 3*a* and the direction of movement of the drive unit 5 being slightly out of parallel with respect to one another. The risk of jamming is additionally reduced by the sliding ring 13. On account of the floating bearing arrangement and on account of the non-positive connection by means of springs 11, 12, the risk of pressure shocks from the plunger rod 3*a* acting on the connection piece 10 as occur during the shot is also reduced. Moreover, vent passages 15 are provided in the connection piece 10 and/or in the closure piece 30, opening out in the space between the inner surface 16 of the connection piece 10 and the surface 14 of the securing head 8 or in a receiving pocket for the spring 12. By virtue of the vent openings 15, it is possible to prevent the formation of air cushions in the event of a movement of the securing head 8 with respect to the bearing socket 9.

Moreover, the plunger rod 3*a* is provided with a cooling passage 22 in a manner which is known per se. A coolant can circulate within the plunger rod 3*a* through the cooling passage 22, which is of double-walled design (not shown). A coolant line 21 is provided for supplying the coolant. In the installation position of the apparatus 1, the coolant line 21 extends plumb downwards. The oscillation generator 6 likewise extends plumb downwards. As a result, torques produced by the force of gravity which could act on the plunger rod 3*a* from the oscillation generator 6 and/or from the coolant line 21 are prevented.

Figure 3:
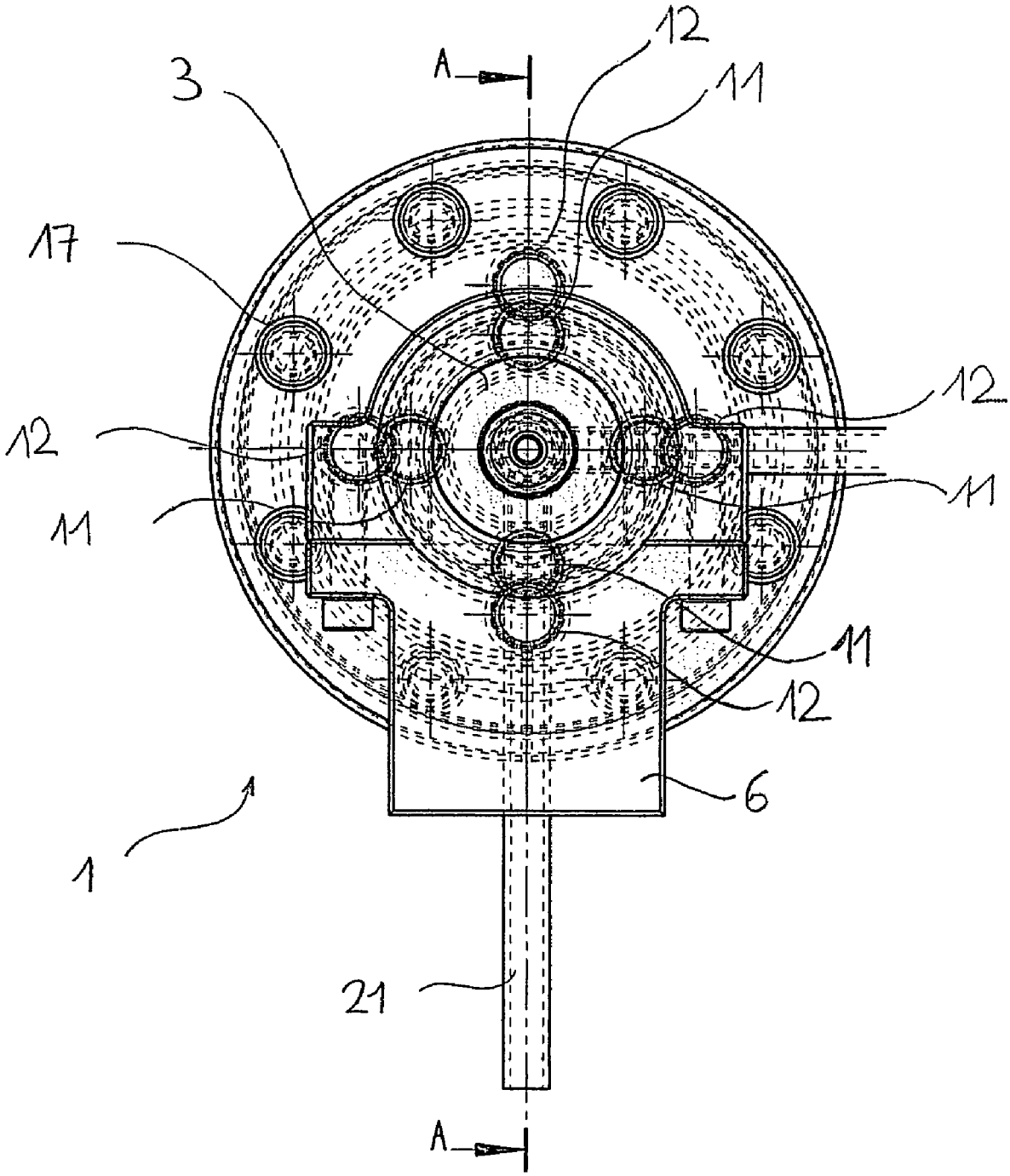
FIG. 3 shows a plan view of the injection plunger as shown in FIG. 2.

FIG. 3 shows a plan view of the arrangement shown in FIG. 2. The securing head 8 is supported in the bearing socket 9 by in each case four springs 11 which are arranged rotationally symmetrically in spring pockets in the connection piece 10 and by four springs 12 arranged rotationally symmetrically in closure piece 30. The connection between closure piece 30 and connection piece 10 is effected by means of eight screws 17.

I claim:

1. Apparatus for producing shaped parts, said apparatus comprising a shot sleeve into which a melt can be fed, an injection plunger for forcing the melt into a die, a plunger rod for the injection plunger, a drive unit for actuating the injection plunger, and at least one oscillation generator, by means of which the plunger rod oscillates along its longitudinal axis with respect to the drive unit, wherein that the plunger rod is moveably connected or connectable to the drive unit by means forming a longitudinal clearance between the plunger rod and the drive unit for decoupling the plunger rod from the drive unit in such a manner that oscillations from the plunger rod caused by the oscillation generator are not transmitted to the drive unit.

2. Apparatus according to claim 1, wherein the plunger rod is connected to the drive unit in jointed fashion.

3. Apparatus according to claim 1, wherein the plunger rod is connected moveably in the longitudinal direction to the drive unit.

4. Apparatus according to claim 3, wherein the plunger rod is connected to the drive unit by one or more springs with a predetermined spring force for generating a counter-pressure.

5. Apparatus according to claim 4, wherein the plunger rod, at one end, has an at least partially rounded securing head, which is mounted in sprung fashion in a bearing socket at a connection piece of the drive unit.

6. Apparatus according to claim 5, wherein the securing head is held in the longitudinal direction by a set of springs in the connection piece.

7. Apparatus according to claim 5, wherein the securing head is provided with means for reducing the friction between a surface of the securing head and an inner surface of the bearing socket.

8. Apparatus according to claim 7, wherein the means for reducing the friction are a sliding ring.

9. Apparatus according to claim 5, wherein the surface of the bearing socket consists of a material of a greater hardness than the securing head.

10. Apparatus according to claim 9, wherein the surface of the bearing socket is one of hard chrome plated or ionitrided.

11. Apparatus according to claim 5, wherein that the bearing socket is provided with at least one vent opening.

12. Apparatus according to claim 1, in which the plunger rod, in the operating position, runs substantially horizontally, wherein the oscillation generator, in its operating position, is arranged on the plunger rod in such a manner that it is directed vertically downwards.

13. Apparatus according to claim 1, characterized in that the oscillation generator is designed to generate oscillations in the range from 5 Hz to 100 Hz, preferably 30 Hz to 50 Hz.

14. Apparatus for producing shaped parts, said apparatus comprising a shot sleeve into which a melt can be fed, an injection plunger for forcing the melt into a die, a plunger rod for the injection plunger comprising a securing head, a drive unit for actuating the injection plunger rod, and at least one oscillation generator, by means of which for reciprocating the plunger rod oscillates along its longitudinal axis with respect to the drive unit, wherein the plunger rod is connected or connectable to the drive unit in jointed fashion and in sprung fashion so that oscillations are not transmitted from the oscillation generator to the drive unit for preventing the plunger rod from becoming jammed with respect to the drive unit.

15. Apparatus according to claim 14, in which the plunger rod, in the operating position, runs substantially horizontally, wherein the oscillation generator, in its operating position, is arranged on the plunger rod in such a manner that it is directed vertically downwards.

16. Apparatus according to claim 14, characterized in that the oscillation generator is designed to generate oscillations in the range from 5 Hz to 100 Hz, preferably 30 Hz to 50 Hz.

17. In an apparatus comprising a shot sleeve into which a melt can be fed, an injection plunger for forcing the melt into a die, a plunger rod connected to the injection plunger, a drive unit for moving the injection plunger lengthwise, and an oscillation generator for vibrating the plunger rod along its longitudinal axis with respect to the drive unit to vibrate the melt, the improvement comprising a vibration isolating connection between the drive unit and the plunger rod, said connection maintaining a longitudinal clearance between the plunger rod and the drive unit so that oscillations from the plunger rod caused by the oscillation generator are not transmitted to the drive unit.

18. The apparatus of claim 17, wherein the vibration isolating connection comprises a head on one end of the plunger rod, a connection piece forming a bearing socket, the head and the bearing socket having a narrow gap therebetween, and springs for positioning the head in the gap.

* * * * *